US009115679B2

(12) United States Patent
Roseborsky et al.

(10) Patent No.: US 9,115,679 B2
(45) Date of Patent: Aug. 25, 2015

(54) MOUNTING POINT INJECTOR CLIP

(75) Inventors: Steven R. Roseborsky, Kingsville (CA); Dhyana Ramamurthy, Novi, MI (US); Arunchunaikani Thalaimuthu, Sterling Heights, MI (US)

(73) Assignees: DENSO International America, Inc., Southfield, MI (US); DENSO CORPORATION, Kariya-shi, Aichi-ken ( * ) Notice: Subject to any disclaimer, the term of this patent is extended or adjusted under 35 U.S.C. 154(b) by 366 days.

(21) Appl. No.: 13/363,438

(22) Filed: Feb. 1, 2012

(65) Prior Publication Data

US 2013/0192565 A1 Aug. 1, 2013

(51) Int. Cl.
*F02M 61/14* (2006.01)

(52) U.S. Cl.
CPC ..... *F02M 61/14* (2013.01); *F02M 2200/853* (2013.01); *F02M 2200/856* (2013.01)

(58) Field of Classification Search
CPC ..... F02M 61/14; F02M 61/145; F02M 2200/853; F02M 2200/856; F02M 21/0281
USPC ..... 123/445, 456, 468, 469, 470; 239/600; 29/888.01; 285/305, 321
See application file for complete search history.

(56) References Cited

U.S. PATENT DOCUMENTS 5,820,168 A * 10/1998 De Giacomoni ..... 285/192
6,276,339 B1 * 8/2001 Shebert et al. ..... 123/470
6,382,187 B1 * 5/2002 Scollard et al. ..... 123/470
6,457,456 B1 * 10/2002 Scollard et al. ..... 123/470
6,637,411 B2 10/2003 Makiyama
6,705,292 B2 3/2004 Bugos
6,830,035 B2 12/2004 Nishiwaki et al.
6,863,053 B2 * 3/2005 Suzuki et al. ..... 123/470
7,360,524 B2 * 4/2008 Zdroik et al. ..... 123/470
7,556,022 B1 * 7/2009 Doherty et al. ..... 123/470
2005/0161025 A1 * 7/2005 Braun et al. ..... 123/470
2010/0218743 A1 * 9/2010 Marc et al. ..... 123/470

FOREIGN PATENT DOCUMENTS

EP 1892408 B1 * 10/2009

* cited by examiner

*Primary Examiner* — Erick Solis
*Assistant Examiner* — Josh Campbell
(74) *Attorney, Agent, or Firm* — Harness Dickey & Pierce P.L.C.

(57) ABSTRACT

A fuel injector mounting assembly including a mounting clip. The mounting clip includes a frame, a first leg, a second leg, a first arm, and a second arm. The frame includes a first side, a second side, and a generally planar surface extending between the first side and the second side. The first arm extends from the first side of the frame. The first arm includes a fuel cup support portion aligned with the first leg and extending in generally the same direction as the first leg, a raised surface of the fuel cup support portion configured to cooperate with the fuel cup, and a flange at an end of the fuel cup support portion, the flange extending away from the first leg. The second arm extends from the second side of the frame and is at least substantially similar to the first arm.

17 Claims, 9 Drawing Sheets

MOUNTING POINT INJECTOR CLIP

FIELD

The present disclosure relates to a fuel injector, and more specifically to a mounting point fuel injector clip.

BACKGROUND

This section provides background information related to the present disclosure which is not necessarily prior art.

A typical vehicle combustion engine includes a plurality of fuel injectors, each of which sprays pressurized fuel from a fuel injector rail into a cylinder head of the engine. Each fuel injector is connected to the fuel injector rail with, in part, a fuel cup. A mounting clip engaging both the fuel injector and the fuel cup restricts relative movement between the fuel injector and the fuel cup. While current mounting clips are suitable for their intended use, they are subject to improvement, such as to enhance connection of the mounting clip to the fuel cup.

SUMMARY

This section provides a general summary of the disclosure, and is not a comprehensive disclosure of its full scope or all of its features.

The present teachings provide for a fuel injector mounting assembly including a mounting clip. The mounting clip includes a frame, a first leg, a second leg, a first arm, and a second arm. The frame includes a first side, a second side, and a generally planar surface extending between the first side and the second side. The first leg extends from the first side of the frame generally perpendicular to the planar surface. The second leg extends from the second side of the frame generally perpendicular to the planar surface. The first arm extends from the first side of the frame. The first arm includes a fuel cup support portion aligned with the first leg and extending in generally the same direction as the first leg, a raised surface of the fuel cup support portion configured to cooperate with the fuel cup, and a flange at an end of the fuel cup support portion, the flange extending away from the first leg. The second arm extends from the second side of the frame and is at least substantially similar to the first arm.

The present teachings further provide for a fuel injector mounting assembly including a mounting clip and a fuel cup. The mounting clip includes a frame, first and second legs, first and second arms, first and second flanges, and a head. The first leg and the second leg extend from opposite sides of the frame at a base of the frame. The first arm and the second arm extend from opposite sides of the frame, the first arm is generally aligned with the first leg and the second arm is generally aligned with the second leg. The first flange extends from a first end of the first arm and away from the first leg. The second flange extends from a second end of the second arm and away from the second leg. The head is between the first arm and the second arm. The fuel cup includes a column and defines first, second, and third indentations. The first indentation is configured to accommodate the first flange, the second indentation is configured to accommodate the second flange, and the third indentation is configured to accommodate the head.

The present teachings also provide for a fuel injector mounting assembly including a fuel injector, a fuel cup, and a mounting clip. The mounting clip includes a first arm, a second arm, a first leg, a second leg, and a head. The fuel cup is in cooperation with an inlet of the fuel injector. The first leg and the second leg are coupled to the fuel injector. The first arm of the mounting clip includes a first flange extending within a first indentation of the fuel cup. The second arm of the mounting clip includes a second flange extending within a second indentation of the fuel cup. The head of the mounting clip extends within a third indentation of the fuel cup.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
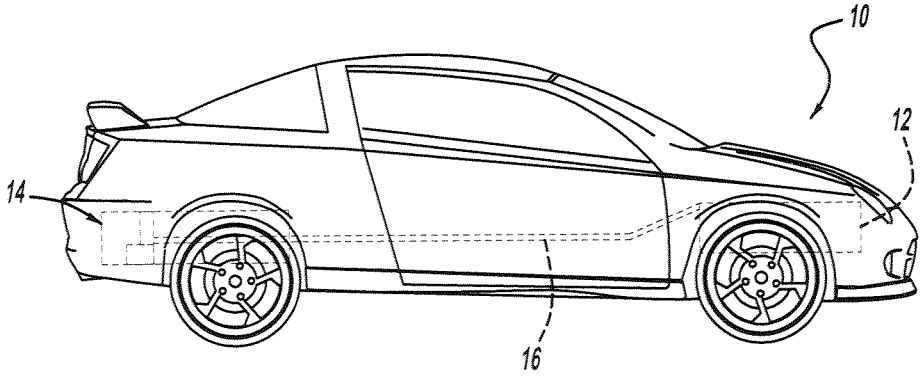
FIG. 1 is a side view of a vehicle including a fuel system according to the present teachings.
Figure 2:
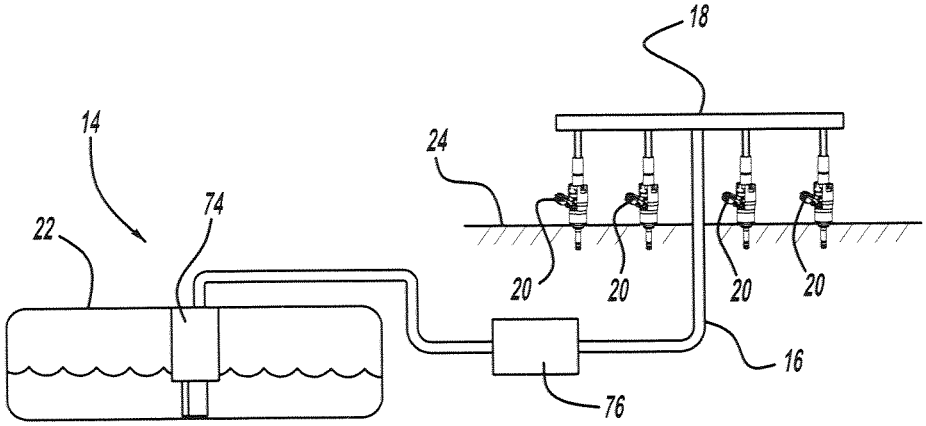
FIG. 2 is a schematic drawing depicting fuel injector mounting assemblies of the fuel system.

With initial reference to FIGS. 1 and 2, a vehicle 10, such as an automobile, including an internal combustion engine 12 that receives fuel from a fuel supply system 14 is illustrated. The fuel supply system 14 generally includes a fuel supply line 16, a common rail or fuel injector rail 18, and a plurality of fuel injectors 20. The fuel injectors 20 are connected to the fuel injector rail 18. A fuel pump module 74 can be mounted within the fuel tank 22 with a flange and can be submerged in or surrounded by varying amounts of liquid fuel within fuel tank 22 when fuel tank 22 includes liquid fuel. An electric fuel pump included with the fuel pump module 74 can pump fuel from fuel tank 22 to a direct injection fuel pump 76, which is a high-pressure pump, through fuel supply line 16. The fuel supply line 16 carries fuel from a fuel tank 22 to the fuel injector rail 18. During operation of the engine 12, fuel passes from the fuel injector rail 18 into the fuel injectors 20 and is subsequently sprayed into the engine 12 through an intake manifold or a cylinder head 24 and into a combustion cylinder for combustion.

Figure 3:
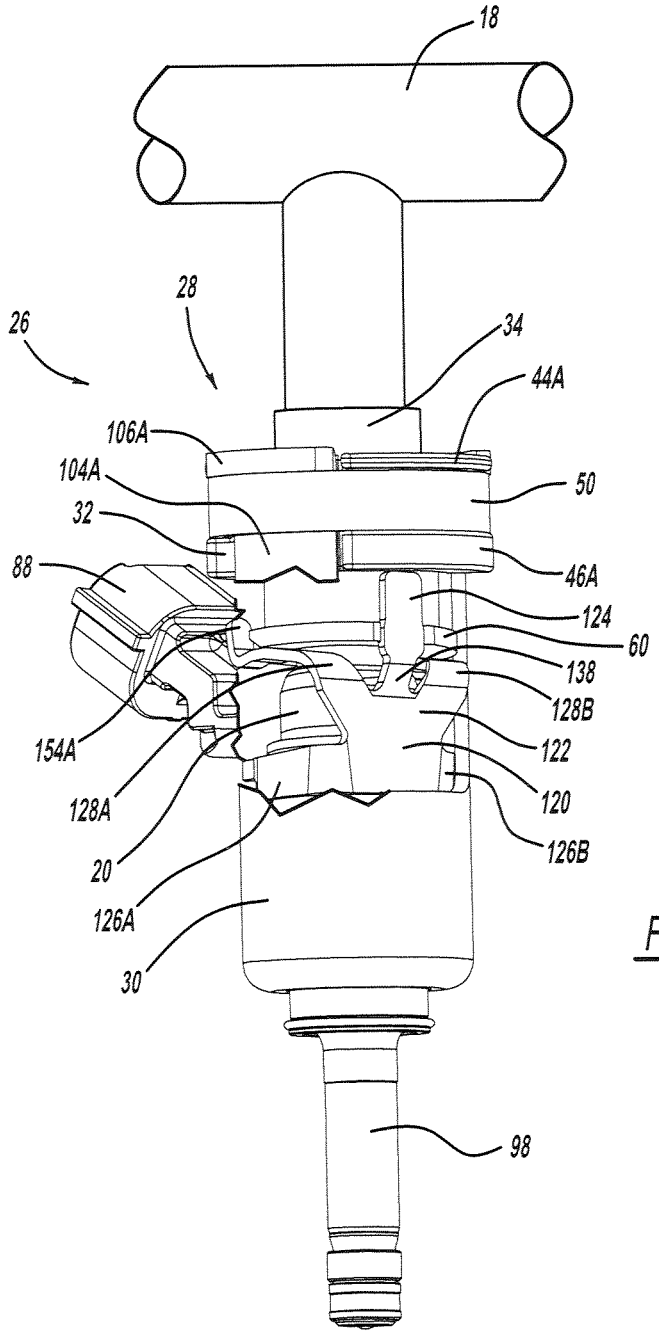
FIG. 3 is a side view of a single fuel injector mounting assembly.
Figure 4:
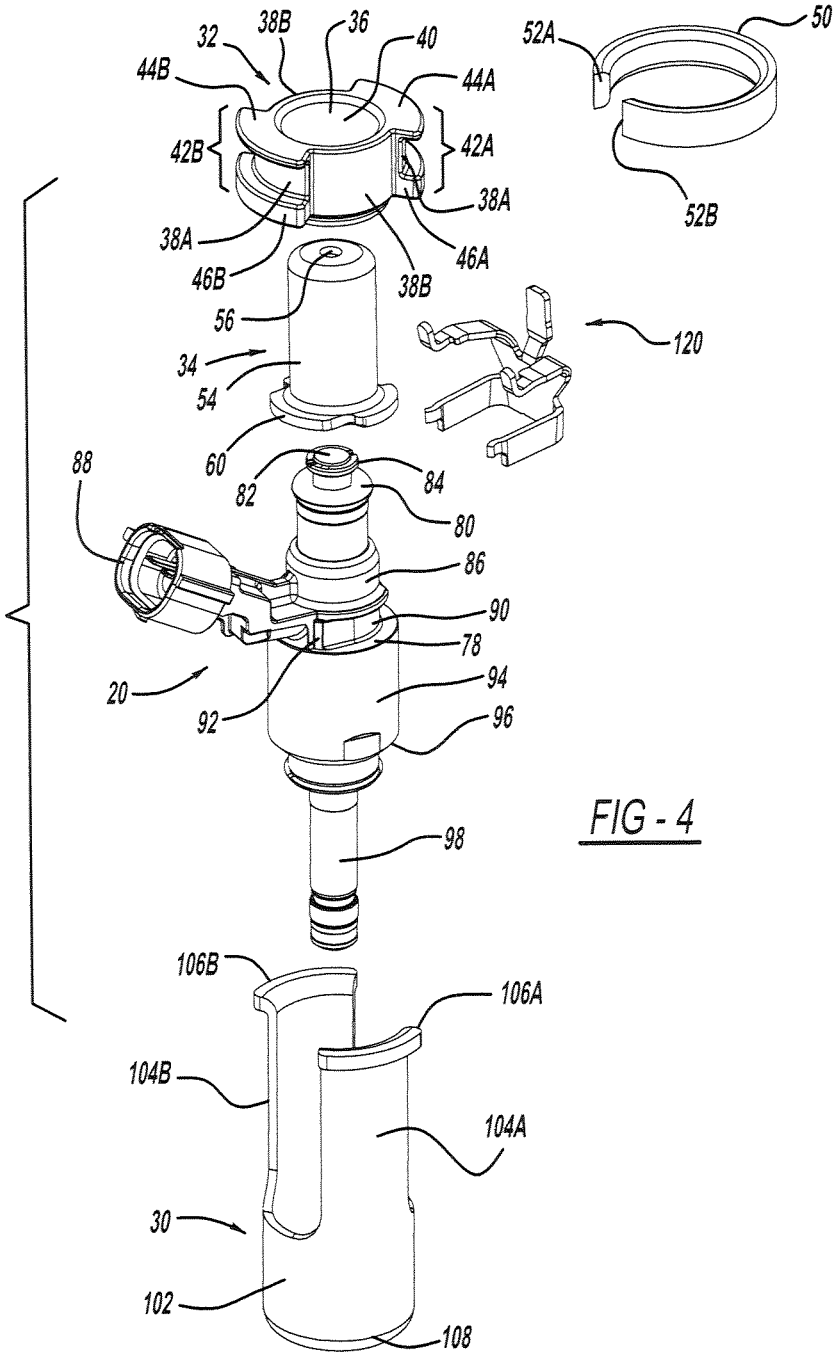
FIG. 4 is an exploded view of the fuel injector mounting assembly of FIG. 3.

With additional reference to FIG. 3, each of the fuel injectors 20 can be mounted in a fuel injector mounting assembly 26, which generally includes a connective inlet assembly 28 and an injector cradle 30. The connective inlet assembly 28 includes an alignment ring 32 and a fuel cup 34 (FIG. 4, for example). The cradle 30, the alignment ring 32, and the collar 50 mounted to the alignment ring 32 are illustrated and described for exemplary purposes only. The cradle 30, the alignment ring 32, and the collar 50 are optional and may be eliminated. Mounting clip 120, as further described herein, includes various features to prevent the clip 120 from disengaging the fuel injector 20 and the fuel cup 34, which further makes the cradle 30 optional. Without the cradle 30, the fuel injector 20 can be seated directly on the cylinder head 24 and the fuel cup 34 can be adequately secured to the fuel injector rail 18 as further described herein.

With continued reference to FIG. 3 and additional reference to FIG. 4, the alignment ring 32 includes an inner wall 36 and an outer wall having first outer wall areas 38A and second outer wall areas 38B. The inner wall 36 defines a center aperture 40. Extending from the first outer all areas 38A is a first pair of retention flanges 42A and a second pair of retention flanges 42B. The first pair of retention flanges 42A is generally arranged opposite to, or about 180° from, the second pair of retention flanges 42B. The first pair of retention flanges 42A includes an upper flange 44A and a lower flange 46A. The second pair of retention flanges 42B includes an upper flange 44B and a lower flange 46B. The first outer wall areas 38A are between the upper flange 44A and the lower flange 46A, and between the upper flange 44B and the lower flange 46B. The first outer wall areas 38A extend outward slightly further from an axial center of the center aperture 40 than do the second outer wall areas 38B. As further described herein, the alignment ring 32 is sized to receive the collar 50 on the first outer wall areas 38A between the upper flanges 44A/44B and the lower flanges 46A/46B. The collar 50 includes a first end 52A spaced apart from a second end 52B.

Figure 5:
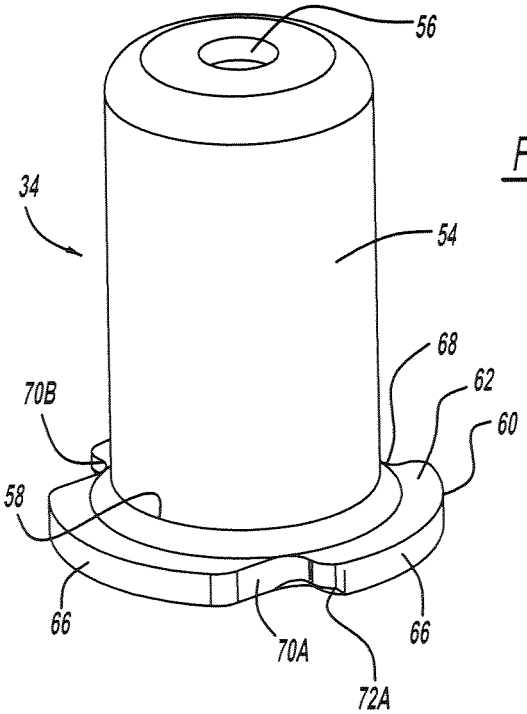
FIG. 5 is a perspective view of a fuel cup of the fuel injector mounting assembly of FIG. 3.
Figure 5A:
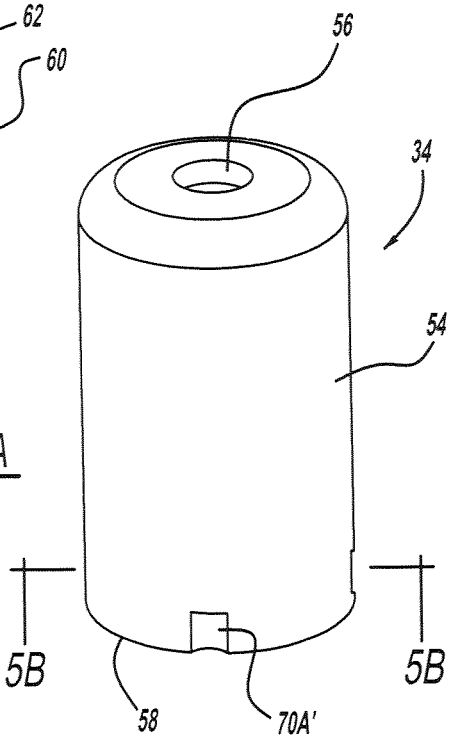
FIG. 5A is a perspective view of another fuel cup according to the present teachings.
Figure 5B:
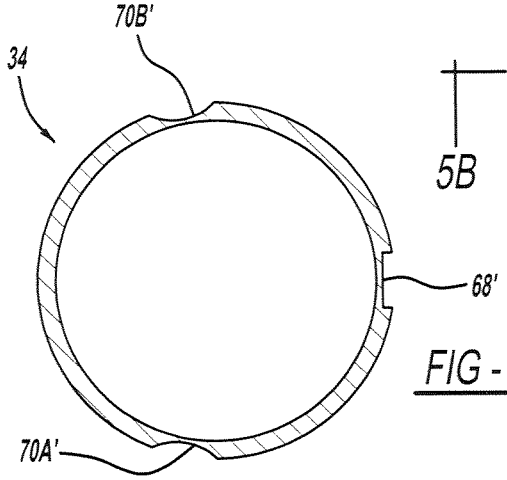
FIG. 5B is a cross-sectional view of the fuel cup of FIG. 5A taken along line 5B-5B of FIG. 5A.
Figure 6:
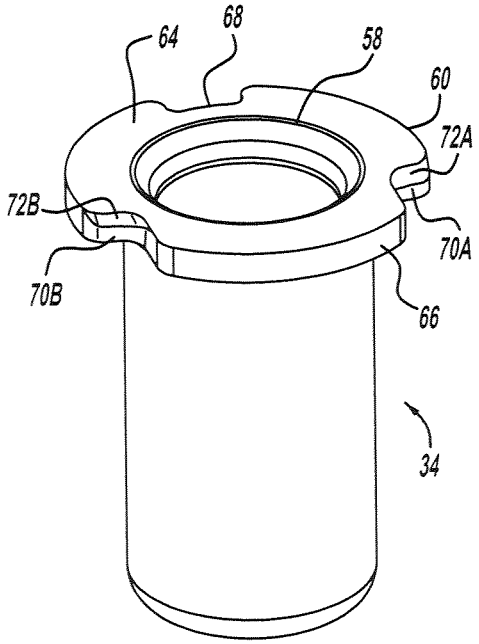
FIG. 6 is another perspective view of the fuel cup.
Figure 7:
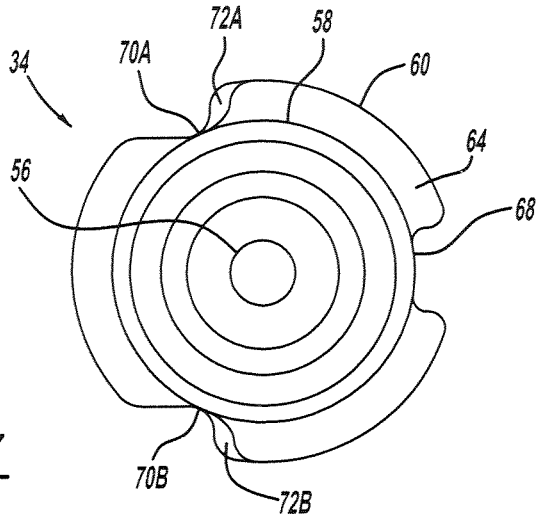
FIG. 7 is a bottom view of the fuel cup of FIG. 5.
Figure 8:
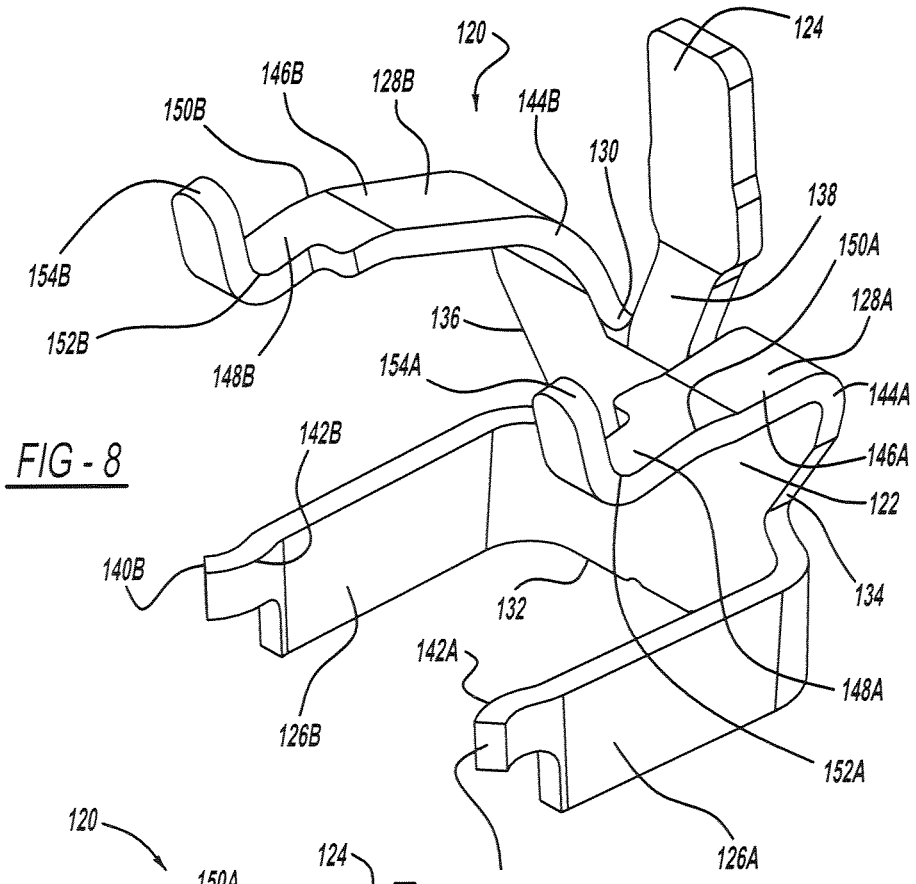
FIG. 8 is a perspective view of a mounting clip of the fuel injector mounting assembly of FIG. 3.
Figure 9:
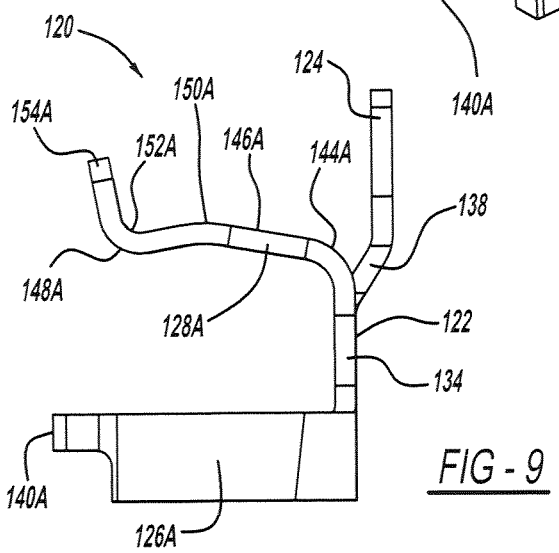
FIG. 9 is a side view of the mounting clip.
Figure 10:
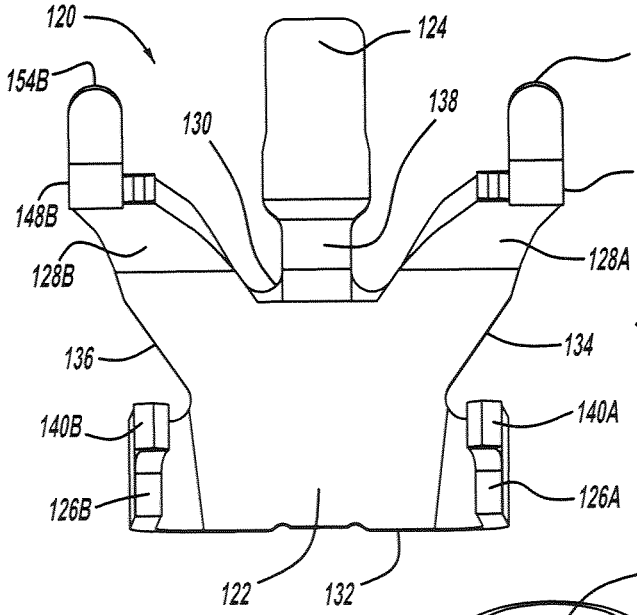
FIG. 10 is a front view of the mounting clip.

With continued reference to FIG. 4 and additional reference to FIGS. 5-7, the fuel cup 34 generally includes a column 54 defining an aperture 56 extending therethrough. Extending from a base 58 of the column 54 is a rim 60. The rim 60 generally includes an upper surface 62, a lower surface 64, and an outer surface 66. The rim 60 defines a first recess or indentation 68, and a pair of second recesses or indentations 70A and 70B, which interrupt and are defined by the outer surface 66, which is otherwise generally circular. The indentations 68, 70A, and 70B are each spaced apart about the rim 60 at about 120° intervals. The second indentations 70A and 70B may be spaced apart at less than 120°. The first indentation 68 is generally arranged equidistant between the pair of second indentations 70A and 70B. At the lower surface 64 are angled or sloped portions 72A and 72B adjacent to each one of the second indentations 70A and 70B respectively. The sloped portions 72A and 72B are generally sloped away from the lower surface 64 and toward the outer surface 66 at each of the first and the second indentations 70A and 70B. With reference to FIGS. 5A and 5B, the fuel cup 34 need not include the rim 60. The first recess or indentation 68 in the rim 60 can thus be replaced with a first recess or indentation 68' formed within the base 58. The second recess or indentations 70A and 70B can be replaced with second recesses or indentations 70A' and 70B' formed within the base 58.

With renewed reference to FIG. 4, the fuel injector 20 generally includes a head portion 80 defining a fuel inlet 82. The head portion 80 further includes an o-ring 84, which generally surrounds, but is spaced apart from, the fuel inlet 82. Adjacent to the head portion 80 is a neck portion 86, which includes an electrical connector 88 and a recessed surface 90. The recessed surface 90 is generally horseshoe shaped and includes connection ridges 92 at both ends thereof (only one of the ridges 92 is shown). The ridges 92 are both proximate to, and on opposite sides of, the electrical connector 88. On a side of the recessed surface 90 opposite to the neck portion 86 is a generally cylindrical body portion 94 including a base 96. Extending from the body portion 94 at the base 96 is a nozzle 98.

With continued reference to FIG. 4, the injector cradle 30 includes a cylindrical base 102 with both a first tab 104A and a second tab 104B extending therefrom. The first tab 104A includes a first flange 106A at an end of the first tab 104A opposite to the cylindrical base 102. The second tab 104B includes a second flange 106B at an end of the second tab 104B opposite to the cylindrical base 102. Extending from an end of the cylindrical base 102 opposite to the first and second tabs 104A and 104B is a tapered base portion 108, which defines an aperture (not shown) configured to receive the nozzle 98 of the fuel injector 20, as further described herein.

With additional reference to FIGS. 8-12, the mounting assembly 26 further includes a mounting clip 120. The mounting clip 120 generally includes a frame 122, a head 124, a first leg 126A, a second leg 126B, a first arm 128A, and a second arm 128B.

The frame 122 is generally planar and includes a first end 130, a second end or base end 132 that is opposite to the first end 130, a first side 134, and a second side 136 that is opposite to the first side 134. The head 124 is connected to the frame 122 with a neck portion 138, which is between the two arms 128A and 128B. The frame 122 and the head 124 each generally extend in parallel, spaced apart planes. The neck portion 138 is angled with respect to the frame 122 and the head 124, and thus extends at an angle not parallel to either the frame 122 or the head 124. The head 124 is therefore offset from the frame 122 at a side of the frame 122 opposite to the legs 126A/126B and the arms 128A/128B.

The first leg 126A extends from the first side 134 of the frame 122 and the second leg 126A extends from the second side 136. The first and the second legs 126A/126B are angled slightly towards each other. The first and the second legs 126A and 126B each include a first curved portion 140A and a second curved portion 140B respectively at ends thereof. The first curved portion 140A defines a first protruding surface 142A and the second curved portion 140B defines a second protruding surface 142B. The first protruding surface 142A and the second protruding surface 142B extend towards one another.

The first arm 128A and the second arm 128B extend from the first end 130 of the frame 122 at opposite sides of the neck portion 138. Both the first arm 128A and the second arm 128B extend upward and away from the first and the second legs 126A and 126B respectively. The first arm 128A is connected to the frame 122 with a first curved base portion 144A and the second arm 128B is connected to the frame 122 with a second curved base portion 144B. A first planar mid portion 146A and a second planar mid portion 146B, which may be curved rather than planar, extend from the first curved base portion 144A and the second curved base portion 144B respectively. Extending from the first planar mid portion 146A is a first hook portion 148A and extending from the second planar mid portion 146B is a second hook portion 148B. Thus, the first planar mid portion 146A is between the first curved base portion 144A and the first hook portion 148A, and the second planar mid portion 146B is between the second curved base portion 144B and the second hook portion 148B.

The first and the second hook portions 148A and 148B include first and second protruding or raised surfaces 150A and 150B respectively. Extending from the first raised surface 150A is a first curved portion 152A. Similarly, extending from the second raised surface 150B is a second curved portion 152B. A first upright flange 154A extends from the first curved portion 152A, and a second upright flange 154B extends from the second curved portion 152B. The first and the second upright flanges 154A and 154B extend upward and away from the first and the second legs 126A and 126B. The first and the second upright flanges 154A and 154B can extend perpendicular to the legs 126A and 126B and parallel to the head 124, or at an angle away from the head 124 as illustrated.

Figure 11:
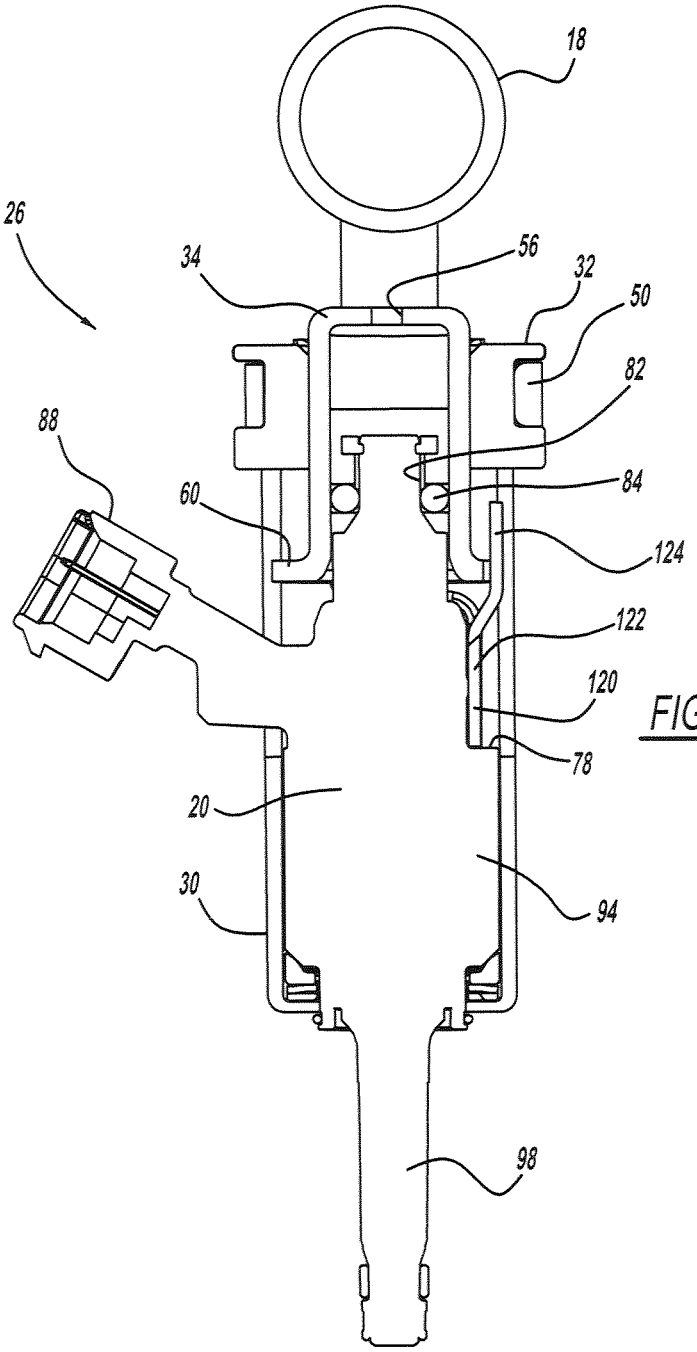
FIG. 11 is a cross-sectional view of the fuel injector mounting assembly of FIG. 3.

When the fuel injector mounting assembly 26 is assembled, the fuel injector 20 is seated within the injector cradle 30 such that the body portion 94 of the fuel injector 20 is within the cylindrical base 102 of the injector cradle 30, and the nozzle 98 of the fuel injector 20 extends from the cylindrical base 102, as illustrated in FIGS. 3 and 11 for example. When the injector cradle 30 is not used, the fuel injector 20 is seated directly on the cylinder head 24. The fuel cup 34 is seated on the head portion 80 of the fuel injector over the fuel inlet 82. The mounting clip 120 is arranged such that the first leg 126A, the second leg 126B, and the base end 132 are seated on the ledge 78. The first leg 126A and the second leg 126B are seated within the recessed surface 90. The first and the second curved portions 140A and 140B of the first and second legs 126A and 126B each extend across one of the ridges 92 such that the first and the second protruding surfaces 142A and 142B are on a side of the ridges 92 opposite to the frame 122, which thus secures the legs 126A and 126B to the fuel injector 20. Because the first and the second legs 126A and 126B are angled and biased towards one another, they exert a clamping force on the fuel injector 20, which further secures the mounting clip 120 in place.

Figure 12:
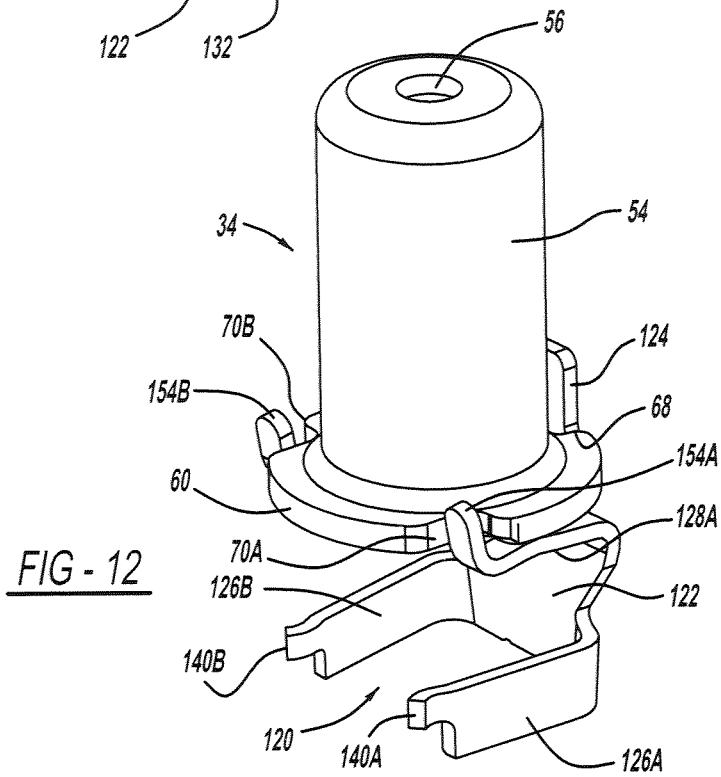
FIG. 12 is a perspective view illustrating cooperation between the fuel cup of FIG. 5 and the mounting clip.
Figure 13:
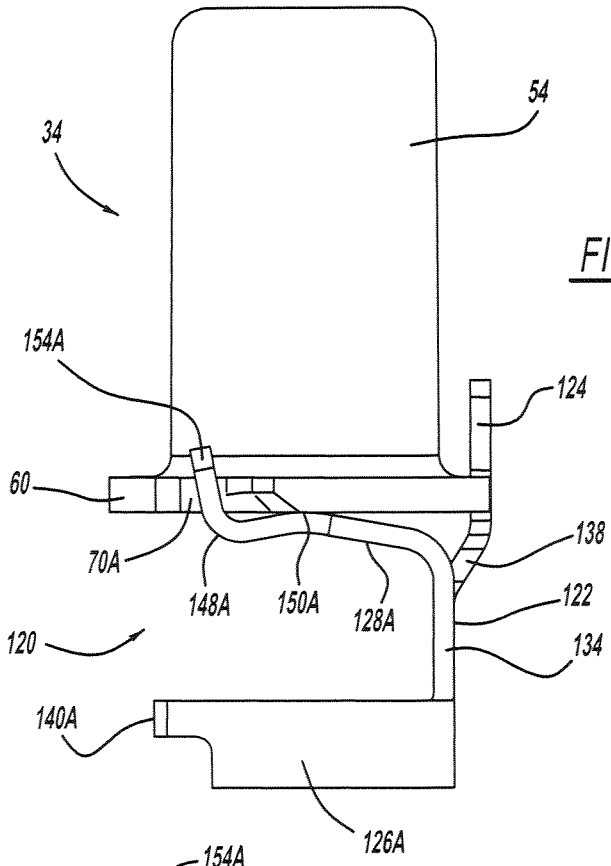
FIG. 13 is a side view illustrating cooperation between the fuel cup of FIG. 5 and the mounting clip.

The mounting clip 120 mates with the fuel cup 34, as illustrated in various figures, including FIGS. 3 and 11-13. FIGS. 12 and 13 illustrate cooperation between the fuel cup 34 and the first and second arms 128A and 128B apart from the rest of the mounting assembly 26 for additional clarity. The head 124 is seated or positioned within the first indentation 68 of the rim 60. Thus, the first upright flange 154A of the first arm 128A is arranged within the first indentation 70A, and the second upright flange 154B of the second arm 128B is arranged within the second indentation 70B. This arrangement restricts rotation of the fuel cup 34, and maintains the retention clip 120 in cooperation with both the fuel injector 20 and the fuel cup 34. For example, cooperation between the first upright flange 154A and the second indentation 70A, as well as cooperation between the second upright flange 154B and the second indentation 70B, provides a positive stop that prevents the mounting clip 120 from becoming separated from the fuel injector 20 and/or the fuel cup 34.

Figure 14:
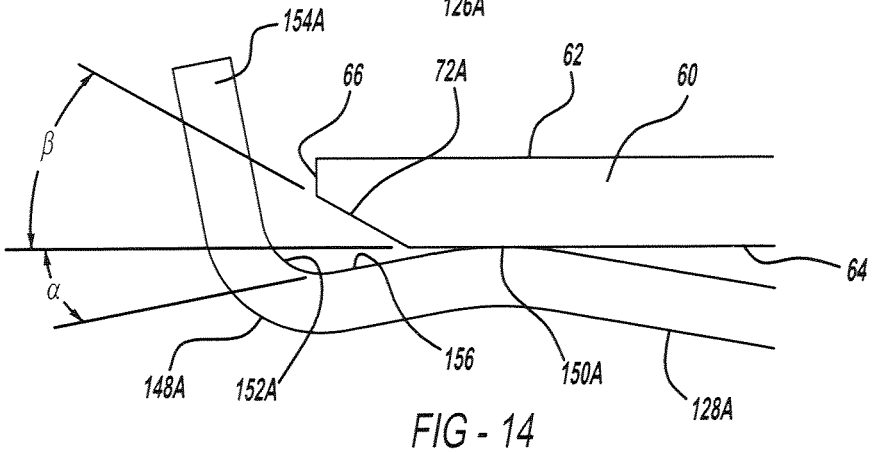
FIG. 14 is a side view illustrating cooperation between an arm of the mounting clip and a rim of the fuel cup of FIG. 5.

With additional reference to FIG. 14, cooperation between the first arm 128A and the fuel cup 34 at the first indentation 70A will be described in additional detail. The first arm 128A only contacts the lower surface 64 of the rim 60 at the first raised surface 150A of the first arm 128A. As a result, a first angle $\alpha$ is defined between the lower surface 64 and a planar surface 156 that is between the first raised surface 150A and the first curved portion 152A. The first angle $\alpha$ can be any suitable angle, such as about 10°. A second angle $\beta$ is defined by the rim 60 between the lower surface 64 and the sloped portion 72A of the lower surface 64. The second angle $\beta$ can be any suitable angle, such as about 30°, and provides clearance between the first upright flange 154A and the lower surface 64 to permit the first upright flange 154A to extend within the second indentation 70B. The first upright flange 154A is arranged opposite to the outer surface 66, which as part of the positive stop prevents the first upright flange 154A from becoming separated from the fuel injector 20 and/or the fuel cup 34. The outer surface 66 provides a stop for the first upright flange 154A even if the second angle $\beta$ is less than 30°, and even if the second angle $\beta$ is 0°. The first planar mid portion 146A, the first raised surface 150A, and the planar surface generally define a first fuel cup support portion of the first arm 128A.

The second arm 128B similarly only contacts the lower surface 64 of the rim 60 at the second raised surface 150B and is substantially similar to, or identical to, the first arm 128A. Cooperation between the second arm 128B and the second indentation 70B is substantially similar to cooperation between the first arm 128A and the first indentation 70A. The first and the second arms 128A and 128B exert upward pressure on the fuel cup 34 and the mounting clip 120 exerts reaction force downward against the ledge 78, which pushes downward on the fuel injector 20 to ensure that the fuel injector 20 is securely seated, particularly when the injector cradle 30 is not used. The forces exerted by the mounting clip 120 provide a tight press fit across the fuel injector mounting assembly 26 and reduce or eliminate undesired movement.

With reference to FIGS. 3, 4, and 11 for example, positioning of the optional alignment ring 32 will now be described. The alignment ring 32 is inserted between the first and the second tabs 104A and 104B of the injector cradle 30. The tabs 104A and 104B are seated against the second outer wall areas 38B of the alignment ring 32. The first flange 106A and the second flange 106B of the cradle 30 are each aligned with the upper flanges 44A and 44B of the alignment ring 32. The collar 50 is positioned within the first outer wall areas 38A and over the first and the second flanges 106A and 106B to clamp the alignment ring 32 to the cradle 30 and thus secure the connective inlet assembly 28 to the cradle 30.

The fuel cup 34 can be connected to the fuel injector rail 18 in any suitable manner, such as by brazing or welding, for example. The connective inlet assembly 28 thus provides a conduit for fuel traveling from fuel injector rail 18 to fuel injector 20, and into engine 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A fuel injector mounting assembly including a mounting clip, the mounting clip comprising:

a frame including a first side, a second side, and a generally planar surface extending between the first side and the second side;

a first leg extending from the first side of the frame generally perpendicular to the planar surface;

a second leg extending from the second side of the frame generally perpendicular to the planar surface;

a first arm extending from the first side of the frame, the first arm separate and spaced apart from the first leg, the first arm including:

a first curved portion extending from the frame that curves away from both the frame and the first leg;

a fuel cup support portion aligned with the first leg and extending in generally the same direction as the first leg;

a raised surface of the fuel cup support portion configured to cooperate with a fuel cup; and a flange at an end of the fuel cup support portion, the flange extending away from the first leg, the flange configured to cooperate with a second indentation at a base of the fuel cup to retain the mounting clip in cooperation with the fuel cup and a fuel injector;

a second arm extending from the second side of the frame, the second arm separate and spaced apart from the second leg, the second arm is at least substantially similar to the first arm, the second arm includes a second curved portion similar to the first curved portion;

a neck portion extending from the frame between the first arm and the second arm; and a head portion extending from the neck portion, the head portion configured to cooperate with a first indentation at the base of the fuel cup to retain the mounting clip in cooperation with the fuel cup and the fuel injector;

wherein the first and the second arms are configured to flex at the first and the second curved portions respectively to exert upward pressure on the fuel cup when in cooperation with the fuel cup to provide a press-fit across the fuel injection mounting assembly and reduce movement of the fuel cup.

2. The mounting clip of claim 1, wherein the second arm is identical to the first arm.

3. The mounting clip of claim 1, the first arm further including a second curved portion between the flange and the raised surface.

4. The mounting clip of claim 1, wherein the flange is angled away from the frame.

5. The mounting clip of claim 1, the first arm further including a planar portion between the raised surface and the frame.

6. The mounting clip of claim 1, wherein the first arm is configured to cooperate with the fuel cup at the raised surface only.

7. The mounting clip of claim 1, wherein the second arm is aligned with the second leg.

8. The mounting clip of claim 1, wherein the first leg and the second leg are at a base of the frame and both the first arm and the second arm are at an end of the frame opposite to the base.

9. A fuel injector mounting assembly comprising:

a mounting clip including:

a frame;

a first leg and a second leg extending from opposite sides of the frame at a base of the frame;

a first arm and a second arm extending from opposite sides of the frame, the first arm generally aligned with and spaced apart from the first leg, and the second arm generally aligned with and spaced apart from the second leg;

a first curved portion of the first arm extending directly from the frame so as to curve away from both the frame and the first leg;

a second curved portion of the second arm extending directly from the frame so as to curve away from both the frame and the second leg;

a first flange extending from a first end of the first arm, the first flange extending away from the first leg;

a second flange extending from a second end of the second arm, the second flange extending away from the second leg; and a neck portion extending from the frame between the first arm and the second arm;

a head extending from the neck between the first arm and the second arm;

a fuel cup including:

a column; and a first indentation defined by the fuel cup and configured to accommodate the first flange, a second indentation defined by the fuel cup and configured to accommodate the second flange, and a third indentation defined by the fuel cup and configured to accommodate the head;

wherein the first and the second arms are configured to flex at the first and the second curved portions respectively to exert upward pressure on the fuel cup when in cooperation with the fuel cup to provide a press-fit across the fuel injection mounting assembly and reduce movement of the fuel cup;

wherein the first, the second, and the third indentations are defined by a rim of the fuel cup and are spaced apart generally equidistant about the rim; and wherein the first flange extends within the first indentation, the second flange extends within the second indentation, and the head extends within the third indentation when the fuel cup is seated on the first arm and the second arm.

10. The fuel injector mounting assembly of claim 9, the fuel cup further including:

a first sloped surface at the first indentation, the first sloped surface extending between a bottom surface of the rim and a side surface of the rim; and a second sloped surface at the second indentation, the second sloped surface extending between the bottom surface of the rim and the side surface of the rim.

11. The fuel injector mounting assembly of claim 9, wherein:

the first arm includes a first raised surface extending therefrom and configured such that when the rim is seated on the first arm, the first arm cooperates with a bottom surface of the rim at the first raised surface only;

the second arm includes a second raised surface extending therefrom and configured such that when the rim is seated on the second arm, the second arm cooperates with the bottom surface of the rim at the second raised surface only.

12. The fuel injector mounting assembly of claim 11, wherein:

the first arm includes a first generally planar surface between the first raised surface and the first flange;

the second arm includes a second generally planar surface between the second raised surface and the second flange;

the first planar surface is angled away from the bottom surface to define a first clearance gap therebetween when the fuel cup is seated on the first arm; and the second planar surface is angled away from the bottom surface to define a second clearance gap therebetween when the fuel cup is seated on the second arm.

13. The fuel injector mounting assembly of claim 10, wherein:

the first flange is opposite to the first sloped surface and the second flange is opposite to the second sloped surface when the rim is seated on the first arm and the second arm;

a first angle is defined between the bottom surface of the rim and the first sloped surface to provide a first clearance between the first flange and the rim; and a second angle is defined between the bottom surface of the rim and the second sloped surface to provide a second clearance between the second flange and the rim.

14. A fuel injector mounting assembly comprising:

a fuel injector;

a fuel cup in cooperation with an inlet of the fuel injector;

a mounting clip including a frame, a first leg, and a second leg, wherein the first and second legs extend from opposite sides of the frame at a base of the frame and are coupled to the fuel injector;

a first arm extending from a first side of the frame and including a first flange configured to cooperate with a first indentation of the fuel cup and a first curved portion that extends away from the first leg, the first arm is separate and spaced apart from the first leg;

a second arm extending from a second side of the frame that is opposite to the first side, the second arm including a second flange configured to cooperate with a second indentation of the fuel cup and a second curved portion that extends away from the second leg, the second arm is separate and spaced apart from the second leg; and a head of the mounting clip extending within a third indentation of the fuel cup, the head extending from a neck portion, the neck portion extending from the frame between the first arm and the second arm;

wherein the first and the second arms are configured to flex at the first and the second curved portions respectively to exert upward pressure on the fuel cup when in cooperation with the fuel cup to provide a press-fit across the fuel injection mounting assembly and reduce movement of the fuel cup; and wherein the fuel cup includes a rim defining the first indentation, the second indentation, and the third indentation.

15. The fuel injector mounting assembly of claim 14, wherein:

the first arm cooperates with the rim only at a first raised surface of the first arm located between the first flange and a frame of the mounting clip; and the second arm cooperates with the rim only at a second raised surface of the second arm located between the second flange and the frame of the mounting clip.

16. The fuel injector mounting assembly of claim 14, wherein the first indentation, the second indentation, and the third indentation are generally spaced apart equidistant about a rim of the fuel cup.

17. The fuel injector mounting assembly of claim 14, wherein:

a first surface at the first indentation is opposite to the first flange;

a second surface at the second indentation is opposite to the second flange; and cooperation between the first surface and the first flange and cooperation between the second surface and the second flange retains the mounting clip in cooperation with the fuel injector.

* * * * *